US008499425B2

(12) United States Patent
Roberts

(10) Patent No.: US 8,499,425 B2
(45) **Date of Patent: *Aug. 6, 2013**

(54) URN WITH FRONT AND REAR INTERCHANGEABLE DECORATIVE PANELS

(76) Inventor: James H Roberts, Royal Oaks, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/104,977

(22) Filed: May 11, 2011

(65) Prior Publication Data

US 2011/0209316 A1 Sep. 1, 2011

Related U.S. Application Data

(63) Continuation-in-part of application No. 12/214,890, filed on Jun. 19, 2008, now Pat. No. 8,074,328, which is a continuation-in-part of application No. 11/977,163, filed on Oct. 23, 2007, now Pat. No. 7,793,393, which is a continuation-in-part of application No. 11/053,264, filed on Feb. 7, 2005, now Pat. No. 7,308,740.

(51) Int. Cl.
*A61G 17/00* (2006.01)

(52) U.S. Cl.
USPC ..... 27/1

(58) Field of Classification Search
USPC ..... 27/1, 35; D99/5; 40/725, 722, 124.5
See application file for complete search history.

(56) References Cited

U.S. PATENT DOCUMENTS

| | | | | | |
|---|---|---|---|---|---|
| 3,167,844 | A * | 2/1965 | Bachofner | 27/1 |
| D268,374 | S * | 3/1983 | Dercks et al. | D99/5 |
| D268,623 | S * | 4/1983 | Dercks et al. | D99/5 |
| D272,577 | S * | 2/1984 | Dercks et al. | D99/5 |
| 4,648,162 | A * | 3/1987 | Daino | 27/1 |
| 5,230,127 | A * | 7/1993 | Zukowski et al. | 27/1 |
| 5,287,603 | A * | 2/1994 | Schorman | 27/1 |
| 5,740,637 | A * | 4/1998 | Snow | 52/136 |
| D440,735 | S * | 4/2001 | Robinson | D99/28 |
| 6,295,705 | B1 * | 10/2001 | Gersten | 27/1 |
| 6,944,921 | B1 * | 9/2005 | Gersten | 27/1 |
| 7,043,803 | B2 * | 5/2006 | Chen | 27/1 |
| 7,191,499 | B2 * | 3/2007 | Davis et al. | 27/1 |
| 7,562,423 | B2 * | 7/2009 | Pryd-Kakuk | 27/1 |
| 8,074,329 | B2 * | 12/2011 | Roberts | 27/1 |
| 8,146,216 | B2 * | 4/2012 | Creager | 27/1 |
| 2006/0207075 | A1 * | 9/2006 | Davis | 27/1 |
| 2007/0084743 | A1 * | 4/2007 | Chu | 206/455 |
| 2009/0030804 | A1 * | 1/2009 | Sell | 705/26 |
| 2012/0180275 | A1 * | 7/2012 | Kocir | 27/1 |

* cited by examiner

*Primary Examiner* — William L. Miller
(74) *Attorney, Agent, or Firm* — Michael A. Guth

(57) ABSTRACT

An urn with one or more removable and replaceable panels which allow for placement of an image, such as by laser engraving, to be done on the removable panel. The panel may be custom engraved and added to a partially complete urn. An urn with an extended base.

15 Claims, 18 Drawing Sheets

2

URN WITH FRONT AND REAR INTERCHANGEABLE DECORATIVE PANELS

CROSS REFERENCE TO RELATED APPLICATIONS

This application is a continuation in part of U.S. patent application Ser. No. 12/214,890 to Roberts, filed Jun. 19, 2008, now issued as U.S. Pat. No. 8,074,328, which is a continuation in part of U.S. patent application Ser. No. 11/977,163 to Roberts, filed Oct. 23, 2007, now issued as U.S. Pat. No. 7,793,393, which is a continuation in part of U.S. patent application Ser. No. 11/053,264 to Roberts, filed Feb. 7, 2005, and now issued as U.S. Pat. No. 7,308,740, all of which are hereby incorporated by reference in their entirety.

BACKGROUND OF THE INVENTION

1. Field of Invention

The present invention is related generally to the field of receptacles and more particularly to an urn which is adapted to contain the cremated remains of a pet or human.

2. Description of Related Art

The cremation of the mortal remains of living creatures, such as pets, has become increasingly popular. This increasing popularity may be because of a change in demographics, and it is less expensive than in ground burials. The result of the cremation process is a volume of bone fragments which are normally reduced to a fine ash by grinding, resulting in about one cubic inch of cremated remains per pound of live body weight.

Some pet owners, or family or friends, choose to retain the cremated remains (also known as cremains) as a memory of the departed loved one. Typically, cremation urns take the form of a vase or a similar type of container where the cremains of the lost loved one are to be placed.

There is an accelerating trend in the afterlife industry towards personalizing the funeral products purchased for the deceased. Rather than providing plastic or tin box urns, for example, such personalizing may include an image remembrance, and in some cases this image is customized to be or contain a photograph of the deceased, or, for animals, an image that includes a breed depiction of the pet in a choice of settings, for example, a farm, country, beach, or mountain setting.

The images can be engraved onto a wooden urn using a laser engraver. In order to maintain inventory of a large variety of images of different breeds in various size urns and types of woods, many urns would need to be engraved and stored. Occasionally, an engraving may be rejected because of deficiencies in the image, or misplacement of the image. This rejection causes a relatively expensive solid hardwood urn to be scrapped.

What is called for is an urn that can be custom engraved, and easily re-engraved in case of error without scrapping an entire urn. What is also called for is an urn which allows for a reduced inventory yet allows for prompt delivery to grieving loved ones.

BRIEF SUMMARY OF THE INVENTION

An urn with a removable and replaceable panel(s) which allows for placement of an image, such as by laser engraving, on a removable panel. The panel(s) may be custom engraved and added to a partially complete urn.

DETAILED DESCRIPTION

Figure 1:
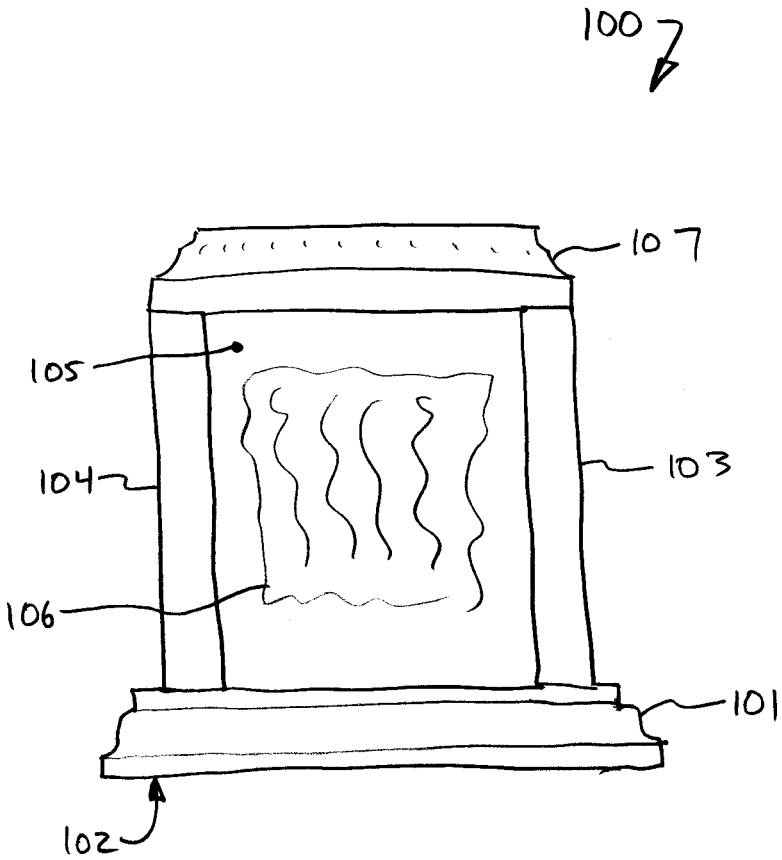
FIG. 1 is a front view of an urn according to some embodiments of the present invention.

FIG. 1 illustrates an urn 100 according to some embodiments of the present invention. The bottom surface 102 of the urn base 101 is adapted to rest upon on a flat surface. The side panels 103, 104 are in substantial contact with the base 101 along their bottom edges. In some embodiments, the side panels 103, 104 are wood and are substantially rectangular in shape. In some embodiments, the side panels 103, 104 are substantially parallel to each other. The urn front panel 105 resides between the side panels 103, 104 as viewed from the front. An image 106 is seen on the front panel 105 in some embodiments. In some embodiments, the front panel is made of wood and the image is a laser engraved image. In some embodiments, the front panel may consist of marble, granite, acrylic, or other suitable materials. The image on the front panel may be a custom image intended to memorialize the pet or person whose remains reside within. The top portion 107 covers over the top of the box created by the front, side, and rear panels.

Figure 2:
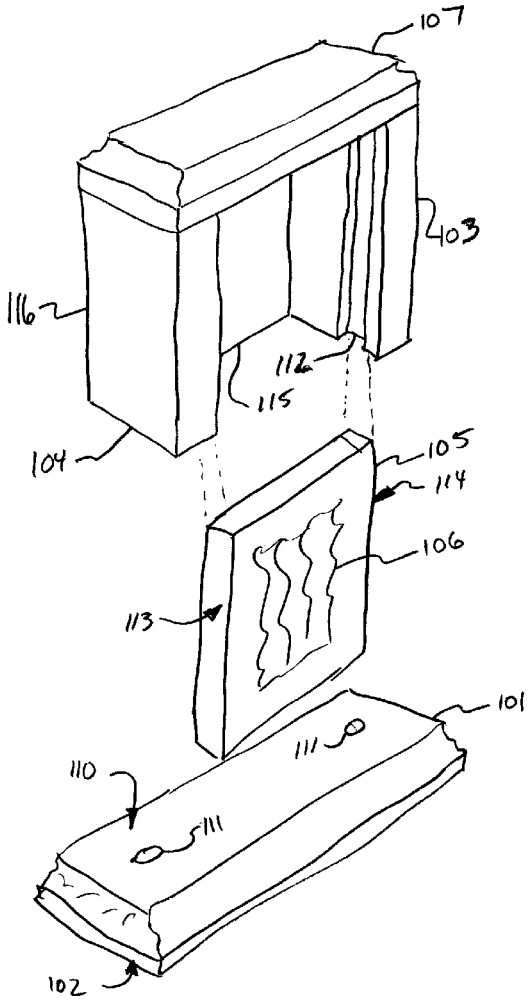
FIG. 2 is an exploded perspective view of an urn according to some embodiments of the present invention.
Figure 10:
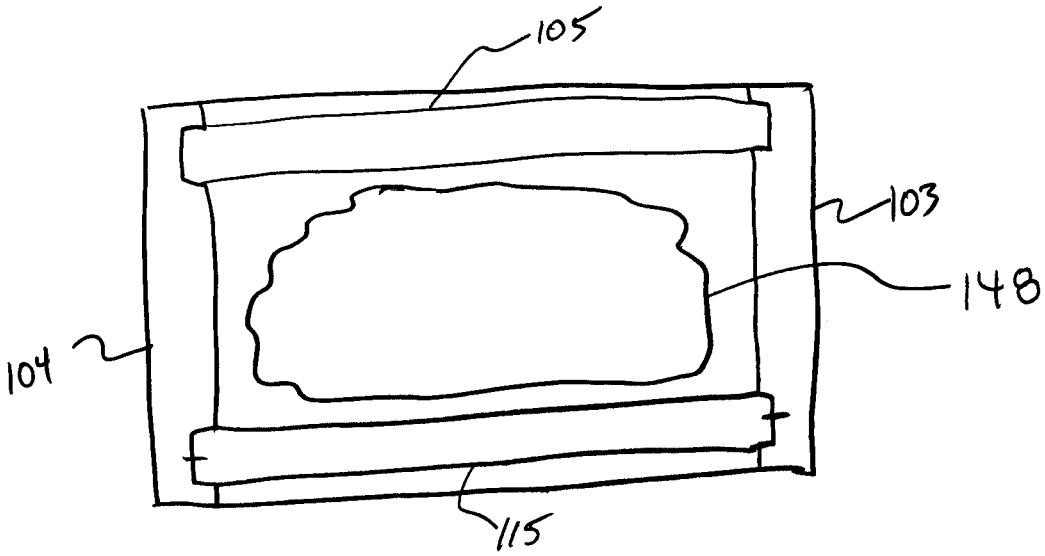
FIG. 10 is a bottom view of an urn body including a four-sided box with a removable panel and cremains according to some embodiments of the present invention.

FIG. 2 illustrates an exploded view of an urn according to some embodiments of the present invention. The bottom surface 102 of the base 101 is adapted to lay on a flat surface in some embodiments. Holes 111 in the base 101 are used for attaching the base 101 to the urn body 116. Screws are used to attach the base 101 to the side panels 103, 104. The screws may come up through the base 101 and thread into threaded inserts in the side panels, or they can be threaded directly into the side panels. The top portion 107, the side panels 103, 104, and the back portion 115 may be pre-assembled into the urn body 116. The front panel's sides 113, 114 may be inserted into slots in the side panels. In some embodiments, the front panel 105 slides into the urn body from the bottom. In some embodiments, the front panel 105 fits snugly into the slots 112, 120, and is sized so that it just fits vertically within the space between the top portion 107 and the base 101. In some embodiments, the front panel has slots in it which fit into guides on the side panels. The front panel 105 is easily removable and replaceable. The top surface 110 of the base 101 then captures and retains the front panel 105 when the base 101 is attached to the urn body 116. In some embodiments, the top surface 110 of the base 101 is substantially flat. In some embodiments, the top surface 110 of the base 101 may be recessed for the urn body and front panel. With the front panel in place and the base attached, the urn becomes a closed receptacle which can be used for the remains of a cremated entity in some embodiments. Typically, the remains will be in a separately sealed bag. As seen in FIG. 10, the remains (cremains) 148, typically in a sealed bag, reside within the urn. The front panel 105 is adapted to be easily removed from the urn body 116 when the base 101 is removed.

In some embodiments, the front panel will have an image 106. In some embodiments, the image 106 will be an engraved image. In some embodiments, the image 106 will be engraved by a laser. In some embodiments, the image may be engraved using other methods, or may be marked using another method. The image on the front panel may be customized to suit the desires of a purchaser. Because of the multitude of possible images, the front panel may be engraved as one of the last steps in the assembly process. For example, distributors may have an inventory of urns without front panels permanently attached. When an urn is desired with a particular image, a front panel may be engraved separately and inserted after engraving. The engraving of the front panel separately from the rest of the urn has many advantages. If the image is not engraved properly, the image may be re-engraved on the other side of the front panel, so that the front panel does not need to be scrapped. The image may also be re-engraved on another replacement front panel. In this case, the entire urn does not have to be discarded. In either case, the easily removable and replaceable front panel allows for economy of inventory, and allows for a manufacturing error in engraving to be absorbed without wasting a potentially expensive urn. In addition, the engraving of only the substantially flat and rectangular front panel, as opposed to an engraving process where the entire and bulky urn is placed in the engraver if the engraving is done on a panel already assembled into an urn, may allow for a much easier, accurate, and controllable engraving process. Utilizing such a system, an afterlife service and product provider may be able to keep a reduced inventory of plain (unengraved) urns. When an order for a custom engraving is received, the front panel may be manufactured and then easily mailed to the provider, where the cremains are added and it is then assembled into a completed unit. The expedited delivery of only the decorative panel allows for the use of inexpensive overnight delivery in a padded envelope, for example, as opposed to a much longer delivery time for a parcel with an entire urn.

Figure 9:
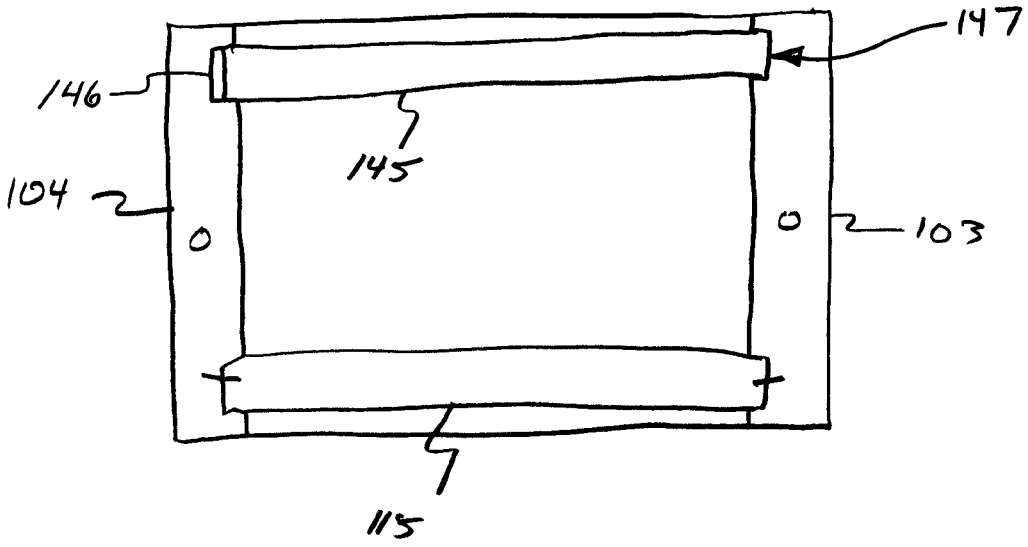
FIG. 9 is a bottom view of an urn body including a four-sided box with a removable panel and a shim according to some embodiments of the present invention.

In some embodiments, the image on the front panel of the urn may be of acceptable image quality such that it is not rejected on that basis, but may be off-center horizontally. In such a case, as seen in FIG. 9, the edge 147 of the panel 145 may be removed by planing or other methods. A shim 146 of appropriate thickness may be inserted into the slot where the other side of the panel resides in order to maintain the snug fit of the now centered panel.

Figure 3:
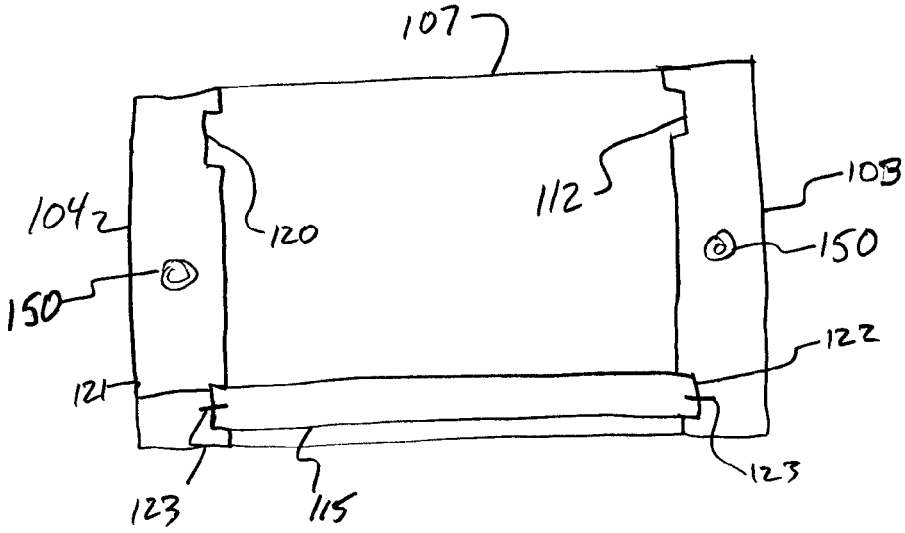
FIG. 3 is a bottom view of an urn body according to some embodiments of the present invention.

In some embodiments, as seen in bottom view in FIG. 3, an urn body has a two side panels 103, 104. The side panels 103, 104 have slots 112, 120 for the later insertion of a front panel. The rear portion 115 has been more permanently affixed into slots 121, 122 in the rear portion of the side panels 103, 104. Fasteners 123, such as staples, nails, or slats may be used to fasten the rear portion 115 in some embodiments. In some embodiments, the rear portion 115 is a single panel. In some embodiments, the rear portion is an assembly of pieces. The top portion 107 is affixed to the tops of the rear portion 115 and the side panels 103, 104. In some embodiments, the top portion is affixed using adhesives. In some embodiments, the rear portion is affixed to the side panels with adhesives. In some embodiments, the base is attached to the urn body with threaded fasteners. The fasteners may come up through the bottom of the base and into threaded keepers 150 in the side panels 103, 104. In some embodiments, the fasteners may attach directly into the side panels.

Figure 4:
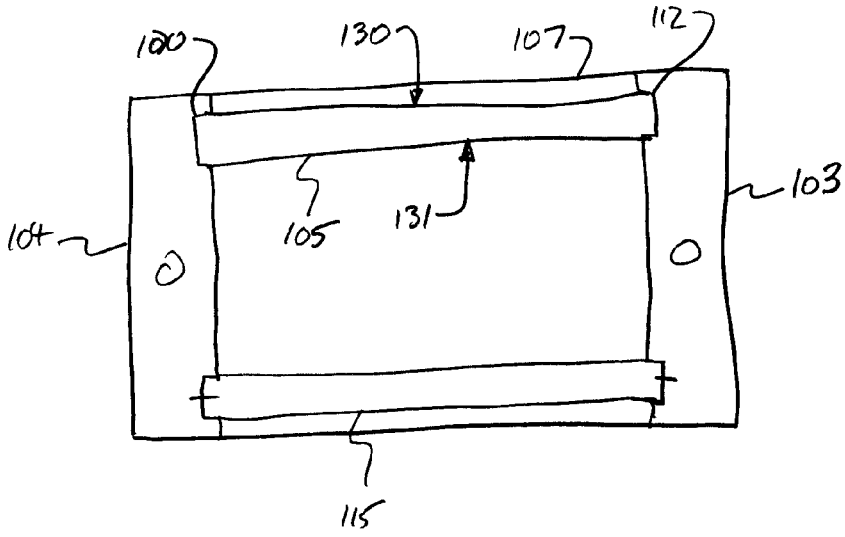
FIG. 4 is a bottom view of an urn body including a removable panel according to some embodiments of the present invention.

FIG. 4 is a bottom view of an urn body with a front panel 105 inserted. A first side 130 and a second side 131 of the front panel 105 may be used for the engraving of an image. In some embodiments, the front panel 105 is made of wood. In some embodiments, the image is engraved on the front panel 105 with a laser. An image may be engraved on the first side 130 of the front panel 105 prior to the insertion of the front panel 105 into the urn body. If, upon inspection, the image on the front panel does not meet standards when the urn is assembled, the urn may be easily disassembled and the front panel may be re-used on the second side 131. The urn may then be re-assembled with the second side 131 facing outwards. In some cases, the front panel may be manufactured with a different view on each side, allowing the customer to select which image is preferred upon review. For example, a breed may have both long ears and cropped ears. An image of each may be engraved, one on each side of the panel. The chosen depiction may be displayed when the urn is fully assembled, without delaying the engraving process and the delivery of the panel.

Figure 5:
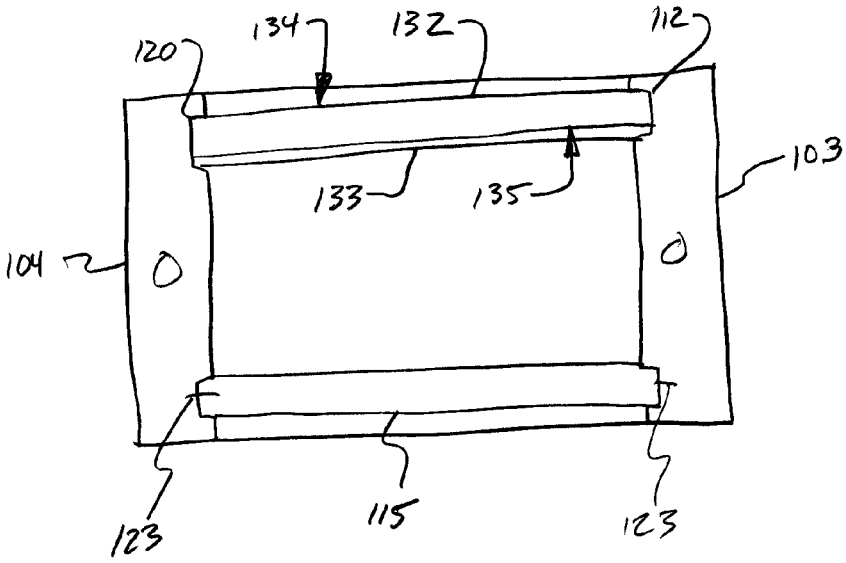
FIG. 5 is a bottom view of an urn body including a removable panel/clear pane combination according to some embodiments of the present invention.
Figure 6:
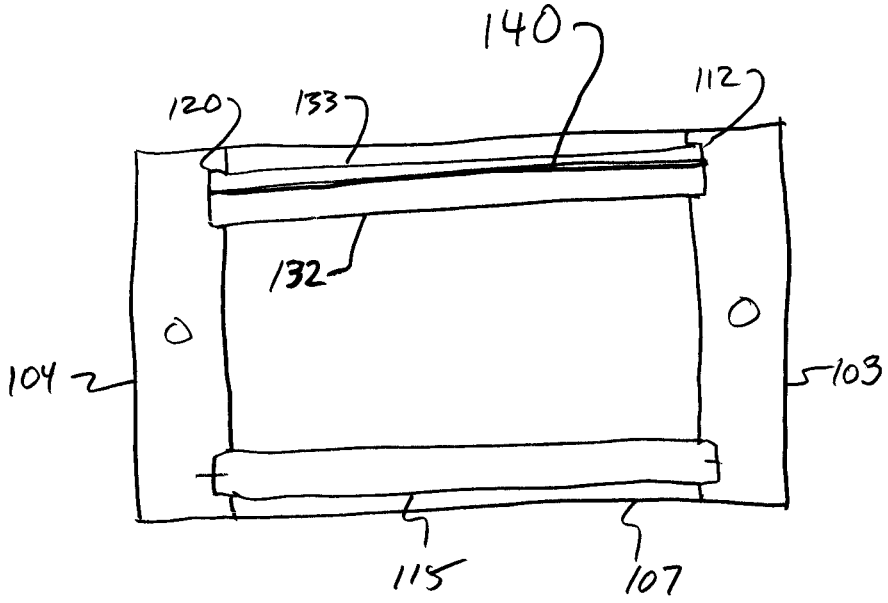
FIG. 6 is a bottom view of an urn body including a removable panel/clear pane combination according to some embodiments of the present invention.

In some embodiments, as seen in bottom view in FIGS. 5 and 6, the slots 112, 120 in the side panels 103, 104 may be adapted to seat a first partial panel 132 and a second partial panel 133. In some embodiments, the first partial panel 132 is made of wood or other material, and the second partial panel 133 is a pane made of a clear material, such as acrylic or glass. In some embodiments, the two partial panels 132, 133 are sized such that there combined thicknesses allow for a snug fit into the slots 112, 120 in the side panels, while still allowing for easy removal and replacement. The two partial panels allow for the same combination of parts to be used while offering a variety of advantages. The first partial panel 132 may be engraved on one of its surfaces 134, 135 such that an image is displayed outwardly. As in other embodiments, the first partial panel 132 may be engraved separately from the urn. Also, the first partial panel 132 may be engraved on the second surface if there is a manufacturing or other problem with the engraving on the first surface. The second partial panel 133 may be inserted on the outside of the first partial panel 132 in some embodiments. A photograph or other image 140 may be inserted between the first partial panel 132 and the second partial panel 133 and will be visible to a viewer observing the front of the urn.

Figure 7:
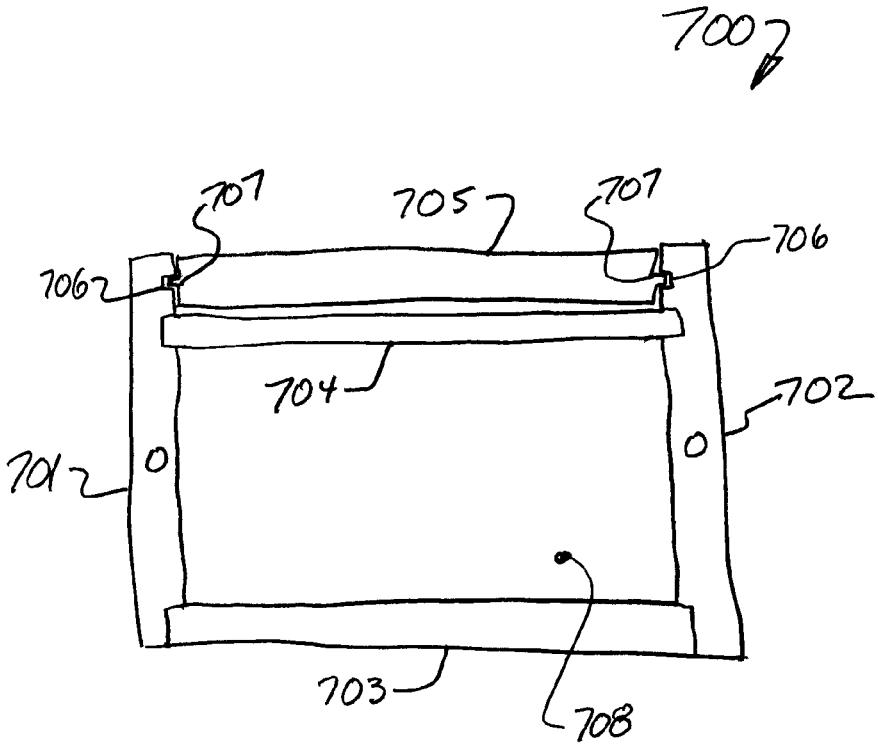
FIG. 7 is a bottom view of an urn body including a four-sided box with a removable additional panel according to some embodiments of the present invention.

In some embodiments of the present invention, as seen in FIG. 7, an urn 700 is shown in bottom view without its base. Two side panels 701, 702 are joined to a back panel 703. In some embodiments, the back panel 703 is made from one or more pieces of wood or other suitable material. A top panel 708 resides on the top of the box assembly.

A front panel 704 is attached to the two side panels 701, 702. The side panels 701, 702 extend past the front panel. A removable panel 705 with guides 707 slides into slots 706 in the side panels 701, 702. In some embodiments, the slots may be in the removable panel. An image may be engraved on either surface of the removable panel 705.

Figure 8:
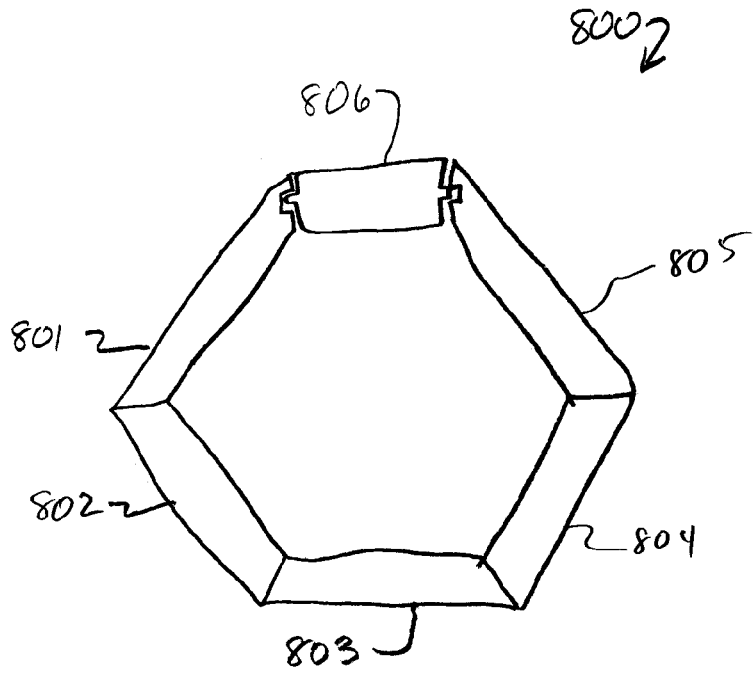
FIG. 8 is a bottom view of a multi-sided urn body with a removable additional panel according to some embodiments of the present invention.

In some embodiments of the present invention, as seen in FIG. 8, the urn body is multi-sided. An urn 800 has a plurality of panels 801-805 joined together to form an urn body. A removable panel 806 is adapted to slide into the urn body. The removable panel is adapted to be captured by the base when the base is attached to the urn body.

Figure 11:
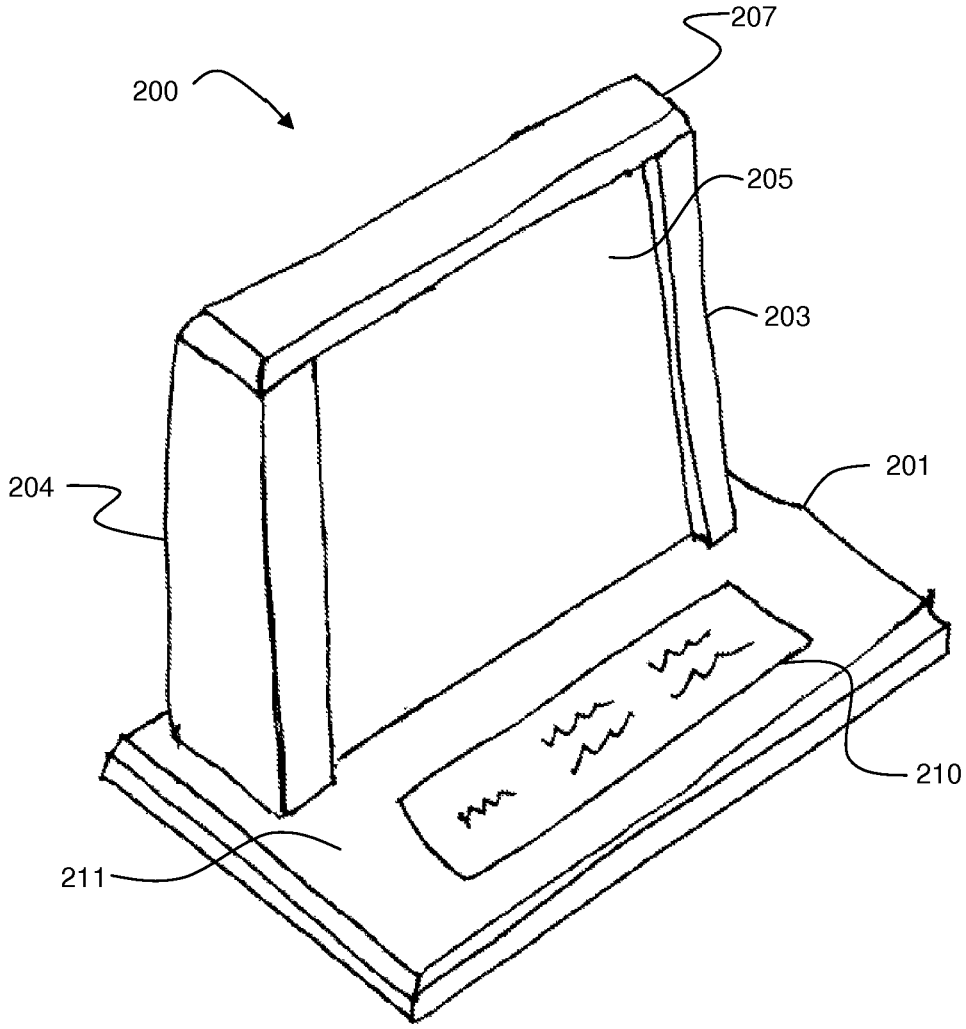
FIG. 11 is a perspective view of an urn with an extended base according to some embodiments of the present invention.

FIG. 11 illustrates an urn 200 according to some embodiments of the present invention. The bottom surface of the urn base 201 is adapted to rest upon on a flat surface. The side panels 203, 204 are in substantial contact with the base 201 along their bottom edges. In some embodiments, the side panels 203, 204 are wood and are substantially rectangular in shape. In some embodiments, the side panels 203, 204 are substantially parallel to each other. The urn front panel 205 resides between the side panels 203, 204 as viewed from the front. An image may be seen on the front panel 205 in some embodiments. In some embodiments, the front panel is made of wood and the image is a laser engraved image. In some embodiments, the front panel may consist of marble, granite, acrylic, or other suitable materials. The image on the front panel may be a custom image intended to memorialize the entity, such as an animal, pet, or person whose remains reside within. The top portion 207 covers over the top of the box created by the front, side, and rear panels.

The urn base 201 may have an extended portion 211 in front of the front panel 205. The urn base 201 may have a plaque 210, or other type of graphical portion on the extended portion 211. The plaque 210 may reside in a recess on the extended portion 211 of the urn base 201. In some embodiments, the urn 200 may have a front panel that is easily removable and replaceable. In some embodiments, one or more panels may be removable and replaceable. In some embodiments, one or more panels may be easily inserted after engraving, or for other reasons that lead to the user wanting to insert the panels later in the assembly process. Although these panels have been referred to as easily removable and replaceable, the user may choose to insert these panels late in the assembly process, and then adhere them to the box structure using adhesives or fasteners.

Figure 12:
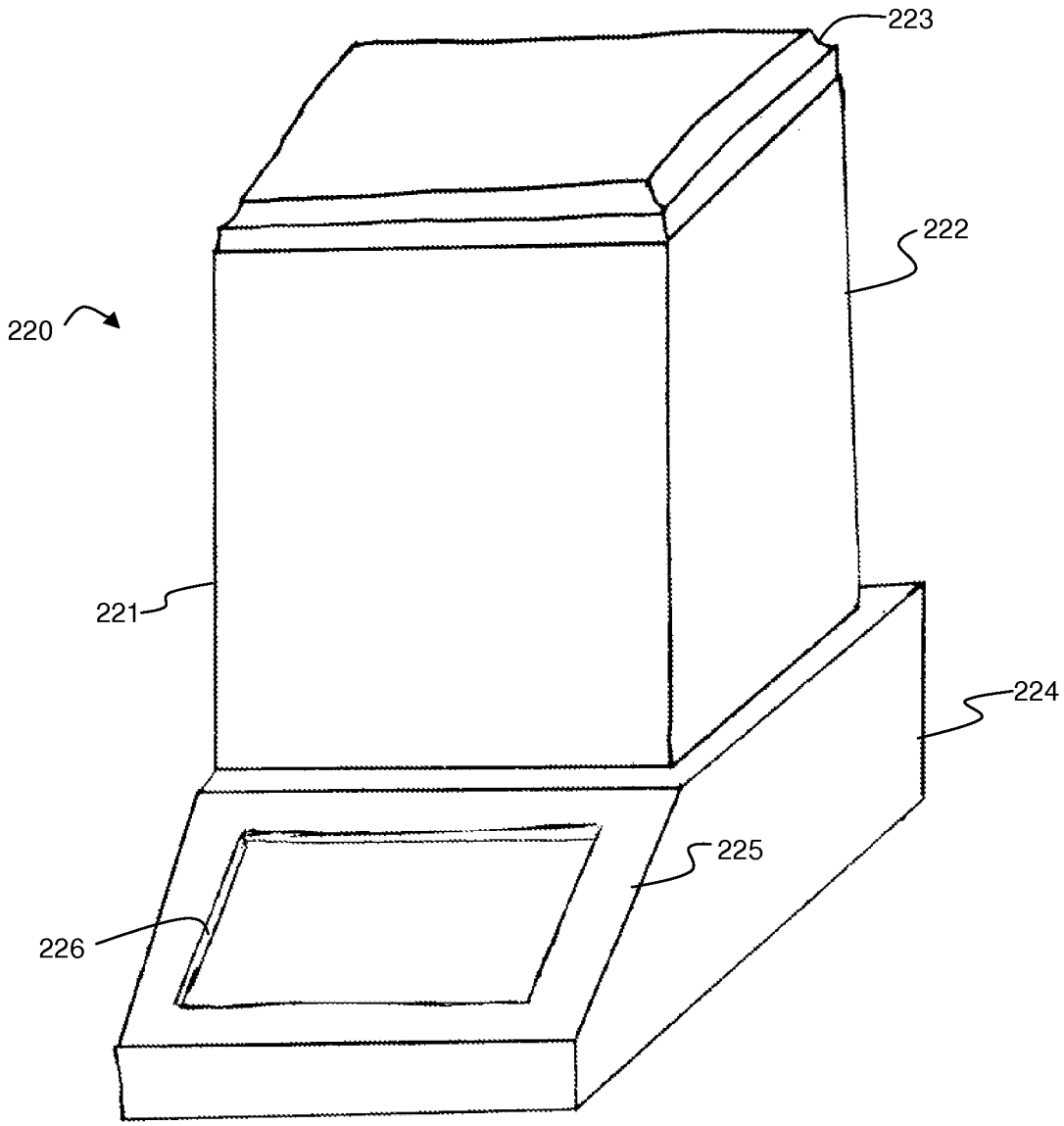
FIG. 12 is a perspective view of an urn with an inclined extended base according to some embodiments of the present invention.

FIG. 12 illustrates an urn 220 according to some embodiments of the present invention. The bottom surface of the urn base 224 is adapted to rest upon on a flat surface. The side panels 221, 222 are in substantial contact with the base 224 along their bottom edges. In some embodiments, the side panels 221, 222 are wood and are substantially rectangular in shape. In some embodiments, the side panels 221, 222 are substantially parallel to each other. The urn front panel resides between the side panels 221, 222 as viewed from the front. An image may be seen on the front panel in some embodiments. In some embodiments, the front panel is made of wood and the image is a laser engraved image. In some embodiments, the front panel may consist of marble, granite, acrylic, or other suitable materials. The image on the front panel may be a custom image intended to memorialize the entity or person whose remains reside within. The top portion 223 covers over the top of the box created by the front, side, and rear panels.

The urn base 224 may have an extended inclined portion 225 in front of the front panel. The urn base 224 may have a plaque, or other type of text, or label, or other graphical portion on the extended inclined portion 225. The plaque may reside in a recess 226 on the extended inclined portion 225 of the urn base 224. In some embodiments, the urn 220 may have a front panel that is easily removable and replaceable. In some embodiments, one or more panels may be removable and replaceable.

Figure 13:
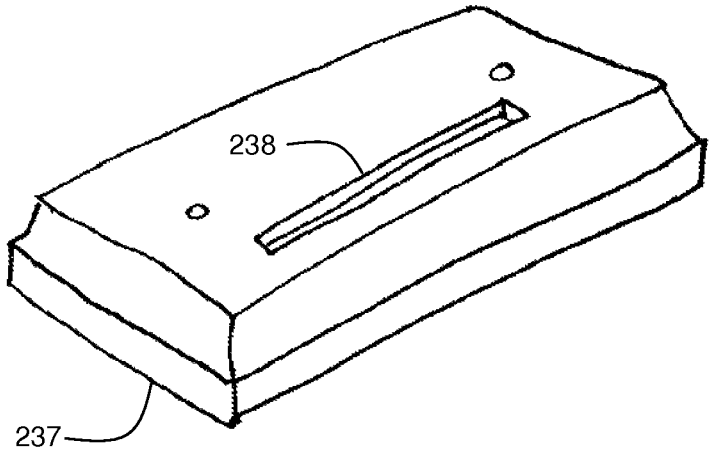
FIG. 13 is a view of an urn base with a single slot according to some embodiments of the present invention.
Figure 14:
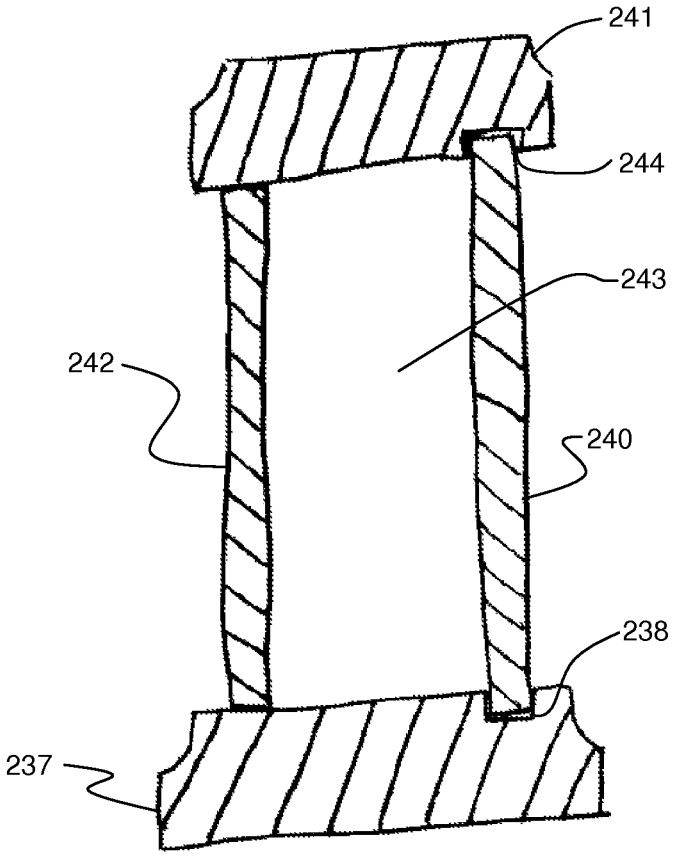
FIG. 14 is a cross-sectional view of an urn with top and bottom slots according to some embodiments of the present invention.

In some embodiments of the present invention, as seen in FIGS. 13 and 14, the removable panel 240 may reside within slots in the top portion 241 of the urn as well as in the base 237. By allowing the removable panel to reside within slots, a variety of advantages may be realized. For example, if the removable panel has been created using a process that may have damaged the top and bottom edges of the panel leaving unsightly marks, these edges of the panel would be hidden from view. Also, if the process of placing graphics on the removable panel is best done without running to the edge of the removable panel, thus creating a border of the graphic, yet one does not wish to see this unfinished border, the border of the graphic (as well as the edges of the panel) may be hidden in these top and/or bottom slots. Coupled with slots in the side panels, all of the edges of the panel may be hidden.

The front panel 240 may be adapted to reside in a slot 238 in the urn base 237. A slot 244 in the top 241 of the urn body provides another recess for the vertical aspect of the front panel. The rear panel 242 may be fixed, or may also be removable in accordance with other embodiments. A center space 243 is captured by the assembled urn.

Figure 15:
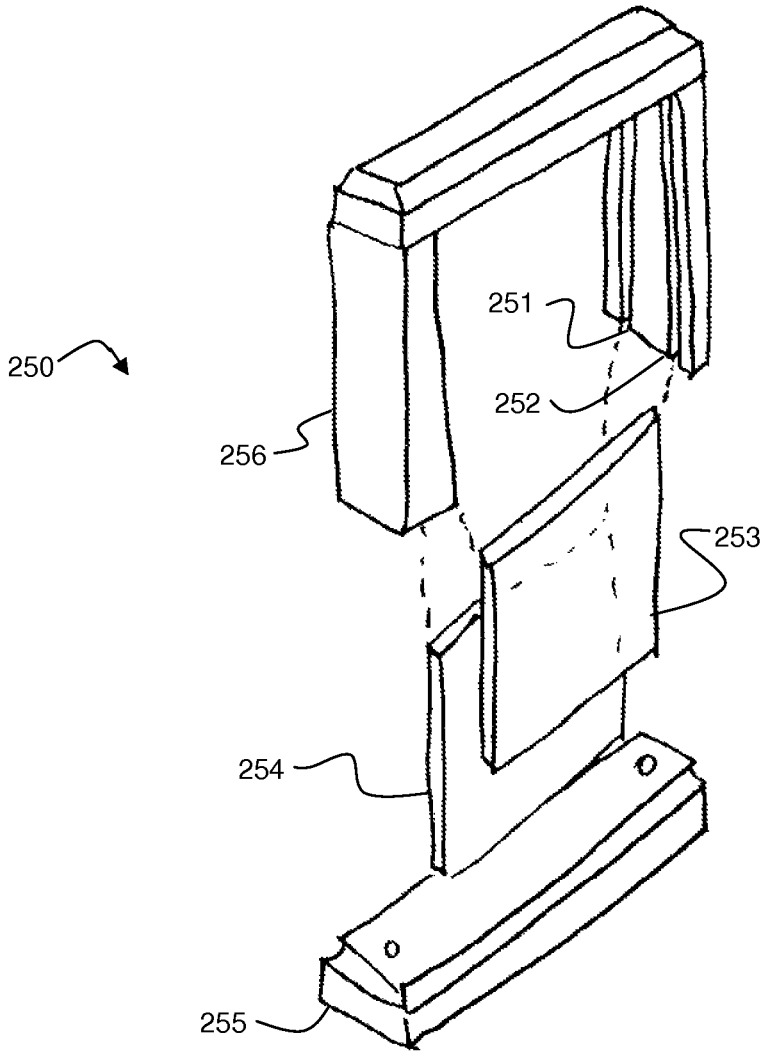
FIG. 15 is an exploded view of an urn with two removable panels according to some embodiments of the present invention.

In some embodiments of the present invention, as seen in FIG. 15, the urn 250 may have two side panels. In some embodiments, the slide in front and rear panels may be easily removable. In some embodiments, the side panels may be attached to the urn top and not be removable. The side panels may be attached for structural rigidity reasons, or for other reasons. The urn body may have side panels with a first set of grooves 251 adapted to capture a first removable panel 254, and a second set of grooves 252 adapted to capture a second removable panel 253. The multiple removable panels may also be used in combination with the slots in the top and bottom portions of the urn in some embodiments. The multiple removable panels may also be used in combination with the urn base with the extended portion, or the urn base with the extended inclined portion, in some embodiments. In some embodiments, the front panel is made of wood and the image is a laser engraved image. In some embodiments, other engraving methods may be used. In some embodiments, the front panel may consist of marble, granite, acrylic, or other suitable materials. The image on the front panel may be a custom image intended to memorialize the pet or person whose remains reside within. In some embodiments, the rear panel is made of wood and the image is a laser engraved image. In some embodiments, other engraving methods may be used. In some embodiments, the rear panel may consist of marble, granite, acrylic, or other suitable materials. The image on the front panel may be a custom image intended to memorialize the pet or person whose remains reside within.

In some embodiments, the front panel assembly adapted to slide into the urn body may be a rear panel portion and a front panel portion which overlay each other. The front panel portion may be a clear material such as acrylic or glass, and the front panel assembly may be adapted to allow for the insertion of an image, such as a photograph, between the front and rear panel portions. In some embodiments, the rear panel assembly adapted to slide into the urn body may be a rear panel portion and a front panel portion which overlay each other. The front panel portion may be a clear material such as acrylic or glass, and the front panel assembly may be adapted to allow for the insertion of an image, such as a photograph, between the front and rear panel portions.

With the use of front and rear removable panels, the advantage of preparing panels, such as decorative panels, separate from the entire urn, is realized. For example, it may be very difficult to engrave an image onto a wooden panel already assembled into an urn. In some cases, as with an extended base, it may very impractical to manufacture. In addition, a removable and replaceable panel also allows for the creation of custom, personalized decorative panels separate in location from the storage area of the urn bodies and bases, allowing for creation and shipment of the decorative panels to a location, such as a retailer, which already has urn bodies in stock. The use of a front and rear removable panel adds an advantage of having a custom image or text on both sides of the urn, which may be of value to users when such an urn is displayed in a relatively open location.

Figure 16:
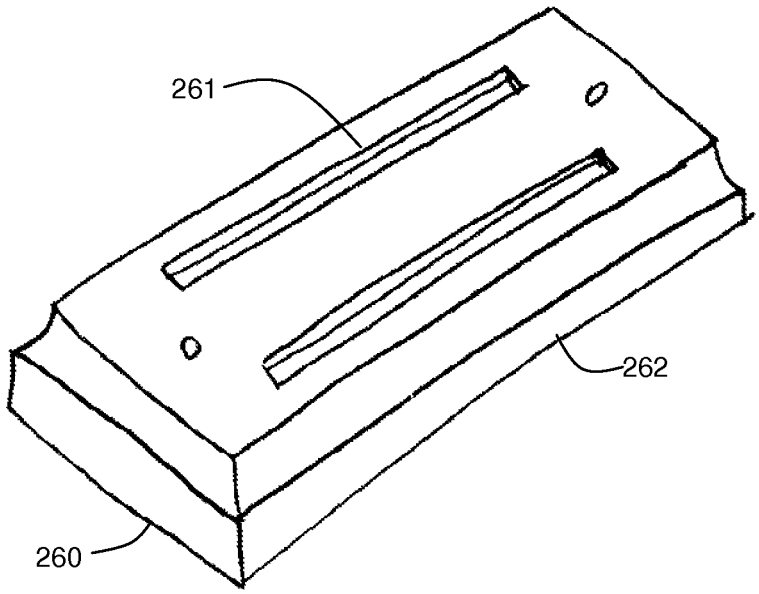
FIG. 16 is a view of an urn base with two slots according to some embodiments of the present invention.

FIG. 16 illustrates an urn base 260 which may be used with an urn body with two removable panels. In these embodiments, the panels may reside in recesses in the urn base, and may also reside within recesses in the top of the urn body.

Figure 17:
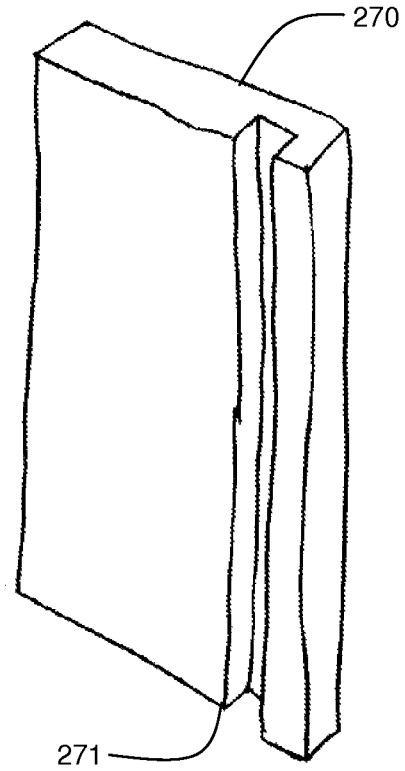
FIG. 17 is a view of a side panel with a groove according to some embodiments of the present invention.
Figure 18:
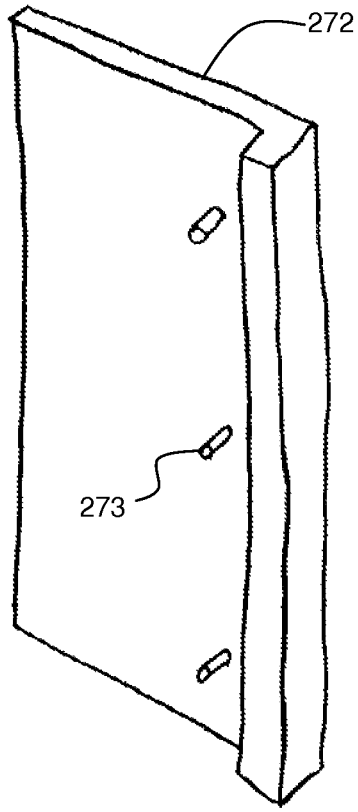
FIG. 18 is a view of a side panel with pins according to some embodiments of the present invention.

FIGS. 17 and 18 illustrate two of the approaches that may be used to capture a removable and replaceable panel. A side panel 270 may have a slot 271 within it, allowing for the sliding in of a removable panel, such as a front panel. The slot 271 may be a groove within a single piece side panel, or the slot may be created by the melding of a plurality of separate pieces into a side panel assembly. FIG. 18 illustrates another approach for capturing a removable panel in a side panel. The side panel 272 may use a standard side 273 for one side of the groove, and may use pins 274 or other retention devices to form the other side of the slot, or may use such devices on both sides.

As evident from the above description, a wide variety of embodiments may be configured from the description given herein and additional advantages and modifications will readily occur to those skilled in the art. The invention in its broader aspects is, therefore, not limited to the specific details and illustrative examples shown and described. Accordingly, departures from such details may be made without departing from the spirit or scope of the applicant's general invention.

What is claimed is:

1. An urn for storing cremains, said urn comprising:

an urn body, said urn body comprising:

a first side panel, said first side panel having an inside face facing the interior of said urn body;

a second side panel, said second side panel having an inside face facing the interior of said urn body;

a top portion, said top portion joined to the top of said urn body;

a bottom edge at the bottom of said urn body;

a back panel portion, said back panel portion adapted to fit with said urn body to form a third side of a box structure, wherein said first side panel and said second side panel define a first and second side of said box structure;

a front panel portion, said front panel portion adapted to fit with said urn body to form a fourth side of said box structure; and a base, said base adapted to fasten to the bottom of said urn body, said base adapted to capture said front panel portion when fastened to said urn body, whereby with said front panel and said base attached to said urn body, sad urn is a closed receptacle for storing said cremains;

wherein said first side panel comprises a first slot along its inside face, and wherein said second side panel comprises a second slot along its inside face, and wherein said first slot and said second slot are adapted to capture two opposing sides of said front panel portion, and wherein said first slot and said second slot extend to said bottom edge of said urn body.

2. An urn for storing cremains, said urn comprising:

an urn body, said urn body comprising:

a first side panel, said first side panel having an inside face facing the interior of said urn body;

a second side panel, said second side panel having an inside face facing the interior of said urn body;

a top portion, said top portion joined to the top of said urn body;

a bottom edge at the bottom of said urn body;

a back panel portion, said back panel portion adapted to fit with said urn body to form a third side of a box structure, wherein said first side panel and said second side panel define a first and second side of said box structure;

a front panel portion, said front panel portion adapted to fit with said urn body to form a fourth side of said box structure; and a base, said base adapted to fasten to the bottom of said urn body, said base adapted to capture said front panel portion when fastened to said urn body, whereby with said front panel and said base attached to said urn body, sad urn is a closed receptacle for storing said cremains;

wherein said first side panel comprises a first slot along its inside face, and wherein said second side panel comprises a second slot along its inside face, and wherein said first slot and said second slot are adapted to capture two opposing sides of said front panel portion, and wherein said first side panel further comprises a third slot along its inside face, and wherein said second side panel further comprises a fourth slot along its inside face, and wherein said third slot and said fourth slot are adapted to capture two opposing sides of said back panel portion, and wherein said first slot and said second slot extend to said bottom edge of said urn body.

3. The urn of claim 2 wherein said third slot and said fourth slot extend to said bottom of said urn body.

4. The urn of claim 3 said top portion comprises slots along it bottom surface, and wherein said base comprises slots along its top surface, said slots adapted to capture the top and bottom of said front panel portion and said back panel portion.

5. The urn of claim 2 wherein said front panel portion is adapted to be removed from said urn by removing said base.

6. The urn of claim 2 wherein said front panel portion comprises an image.

7. The urn of claim 6 wherein said image is engraved on a surface of said front panel portion.

8. The urn of claim 7 wherein said image is laser engraved on a surface of said front panel portion.

9. The urn of claim 2 wherein said back panel portion is adapted to be removed from said urn by removing said base.

10. The urn of claim 9 wherein said back panel portion comprises an image.

11. The urn of claim 10 wherein said image is engraved on a surface of said back panel portion.

12. The urn of claim 11 wherein said image is laser engraved on a surface of said back panel portion.

13. The urn of claim 2 wherein said front panel portion comprises:

a first partial front panel;

a second partial front panel, wherein said second partial front panel comprises a clear material.

14. The urn of claim 13 wherein said first partial front panel and said second partial front panel are adapted to overlay each other.

15. The urn of claim 14 comprising a matte layer between said first partial front panel and said second partial front panel.

* * * * *